US011597414B2

(12) United States Patent
Kounoike et al.

(10) Patent No.: US 11,597,414 B2
(45) Date of Patent: Mar. 7, 2023

(54) METHOD OF ASSEMBLING RAILCAR BOGIE AND WHEEL BASE FIXING JIG FOR USE THEREIN

(71) Applicant: KAWASAKI RAILCAR MANUFACTURING CO., LTD., Kobe (JP)

(72) Inventors: Fumikazu Kounoike, Kakogawa (JP); Toshiaki Iwanaga, Kobe (JP); Makoto Ogura, Kobe (JP); Takuya Nakao, Kobe (JP)

(73) Assignee: KAWASAKI RAILCAR MANUFACTURING CO., LTD., Kobe (JP)

( * ) Notice: Subject to any disclaimer, the term of this patent is extended or adjusted under 35 U.S.C. 154(b) by 1083 days.

(21) Appl. No.: 16/312,633

(22) PCT Filed: Mar. 14, 2017

(86) PCT No.: PCT/JP2017/010181
§ 371 (c)(1),
(2) Date: Dec. 21, 2018

(87) PCT Pub. No.: WO2017/221477
PCT Pub. Date: Dec. 28, 2017

(65) Prior Publication Data

US 2020/0269886 A1 Aug. 27, 2020

(30) Foreign Application Priority Data

Jun. 21, 2016 (JP) ..... JP2016-122414

(51) Int. Cl.
*B61F 5/52* (2006.01)
*B61F 5/30* (2006.01)
(Continued)

(52) U.S. Cl.
CPC ..... *B61F 5/52* (2013.01); *B61F 5/30* (2013.01); *B61F 5/302* (2013.01); *B61F 5/325* (2013.01); *B61K 13/00* (2013.01)

(58) Field of Classification Search
CPC ..... B61F 3/02; B61F 5/00; B61F 5/30; B61F 5/302; B61F 5/32; B61F 5/325; B61F 5/50; B61F 5/52; B61F 15/20; B61K 13/00
See application file for complete search history.

(56) References Cited

U.S. PATENT DOCUMENTS 9,352,757 B2 * 5/2016 Nishimura ..... B61F 3/02
10,723,371 B2 * 7/2020 Tsumura ..... F16F 1/18
(Continued)

FOREIGN PATENT DOCUMENTS

CN 202240995 U 5/2012
CN 102818506 A * 12/2012
(Continued)

*Primary Examiner* — Zachary L Kuhfuss
*Assistant Examiner* — Cheng Lin
(74) *Attorney, Agent, or Firm* — Oliff PLC

(57) ABSTRACT

A method of assembling a railcar bogie includes: a positioning step of locking a wheelbase fixing jig to a pair of axle box devices to position the pair of axle box devices such that a wheelbase between a pair of wheelsets supported by the respective axle box devices becomes a predetermined designed value, the pair of axle box devices being arranged away from each other in a car longitudinal direction, the wheelbase fixing jig extending in the car longitudinal direction; a plate spring arranging step of making the pair of axle box devices support a plate spring extending in the car longitudinal direction; and a bogie frame arranging step of making a longitudinal direction middle portion of the plate spring support a bogie frame and coupling the bogie frame to the pair of axle box devices.

11 Claims, 4 Drawing Sheets

(51) Int. Cl.
*B61K 13/00* (2006.01)
*B61F 5/32* (2006.01)

(56) References Cited

U.S. PATENT DOCUMENTS

| | | | | |
|---|---|---|---|---|
| 2014/0137765 | A1 | 5/2014 | Nishimura et al. | |
| 2014/0144347 | A1* | 5/2014 | Nishimura | B61F 5/50 105/197.05 |
| 2015/0158506 | A1* | 6/2015 | Nishimura | B61F 3/08 105/197.05 |

FOREIGN PATENT DOCUMENTS

| | | | |
|---|---|---|---|
| CN | 102818506 | A | 12/2012 |
| CN | 103687776 | A | 3/2014 |
| JP | 2013-035536 | A | 2/2013 |
| WO | 2013/008468 | A1 | 1/2013 |

* cited by examiner

METHOD OF ASSEMBLING RAILCAR BOGIE AND WHEEL BASE FIXING JIG FOR USE THEREIN

TECHNICAL FIELD

The present invention relates to a method of assembling a railcar bogie and a wheelbase fixing jig for use therein.

BACKGROUND ART

PTL 1 proposes a railcar bogie from which side sills of a bogie frame of the bogie are omitted. In this bogie, a pair of axle boxes arranged away from each other in a car longitudinal direction support both respective end portions of a plate spring, and a middle portion of the plate spring supports a cross beam of the bogie frame. To be specific, the plate spring has both the function of a primary suspension and the function of a conventional side sill. The cross beam includes pressing members at both car width direction end portions thereof. Each of the pressing members is placed on the middle portion of the plate spring so as to be separable from the middle portion.

CITATION LIST

Patent Literature

PTL 1: International Publication No. 2013/008468

SUMMARY OF INVENTION

Technical Problem

In the bogie of PTL 1, the plate spring is not fixed to the bogie frame and the axle boxes. Therefore, in assembling the bogie, in order to keep a wheelbase between a pair of wheelsets at a designed value and arrange the pair of wheelsets in parallel with each other, the wheelbase needs to be suitably measured by using a tape measure or the like. Such work is complex.

An object of the present invention is to facilitate work of keeping a wheelbase at a designed value in assembling a bogie.

Solution to Problem

A method of assembling a railcar bogie according to one aspect of the present invention includes: a positioning step of locking a wheelbase fixing jig to a pair of axle box devices to position the pair of axle box devices such that a wheelbase between a pair of wheelsets supported by the respective axle box devices becomes a predetermined designed value, the pair of axle box devices being arranged away from each other in a car longitudinal direction, the wheelbase fixing jig extending in the car longitudinal direction; a plate spring arranging step of making the pair of axle box devices support a plate spring extending in the car longitudinal direction; and a bogie frame arranging step of making a longitudinal direction middle portion of the plate spring support a bogie frame and coupling the bogie frame to the pair of axle box devices.

A wheelbase fixing jig for use in assembling of a railcar bogie according to another aspect of the present invention is a wheelbase fixing jig configured to position a pair of axle box devices in order that the pair of axle box devices support a plate spring extending in a car longitudinal direction, the pair of axle box devices being arranged away from each other in the car longitudinal direction, the wheelbase fixing jig extending in the car longitudinal direction and including a pair of locking portions located at both respective longitudinal direction end portions of the wheelbase fixing jig, the pair of locking portions being locked to the respective axle box devices.

According to the above method and configuration, before the plate spring and the bogie frame are assembled in assembling the bogie, the wheelbase fixing jig extending in the car longitudinal direction is just locked to the pair of axle box devices. With this, the wheelbase between the pair of wheelsets is kept at a designed value. Therefore, the work of keeping the wheelbase at a designed value when the pair of axle box devices provided away from each other in the car longitudinal direction are made to support the plate spring extending in the car longitudinal direction can be facilitated.

Advantageous Effects of Invention

The present invention can facilitate work of keeping a wheelbase at a designed value in assembling a bogie.

DESCRIPTION OF EMBODIMENTS

Hereinafter, an embodiment will be explained with reference to the drawings. In the following explanation, a direction in which a railcar travels and a carbody extends is defined as a car longitudinal direction, and a crosswise direction perpendicular to the car longitudinal direction is defined as a car width direction. The car longitudinal direction is also referred to as a front-rear direction, and the car width direction is also referred to as a left-right direction.

Figure 1:
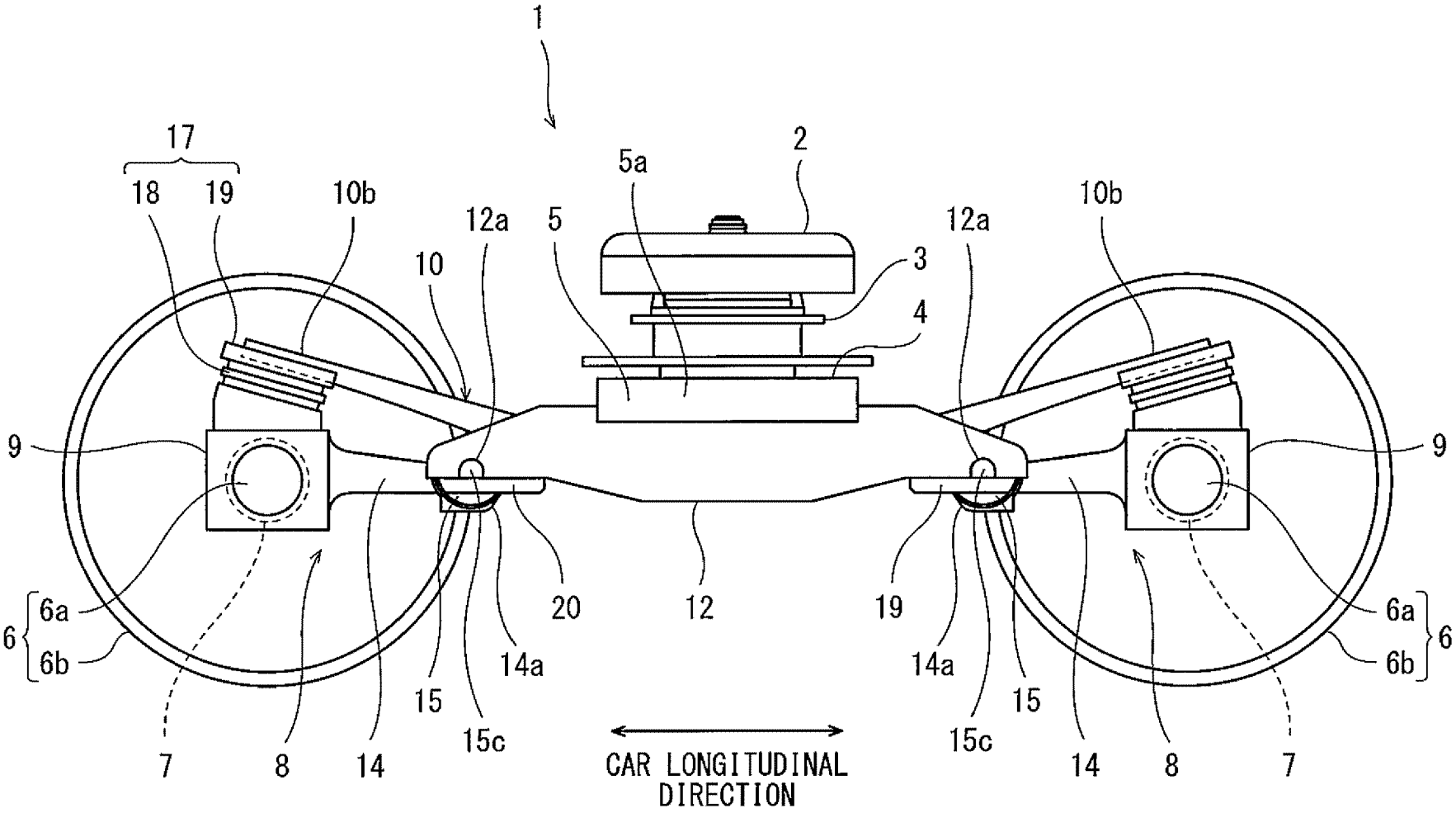
FIG. 1 is a side view of a railcar bogie according to an embodiment.
Figure 2:
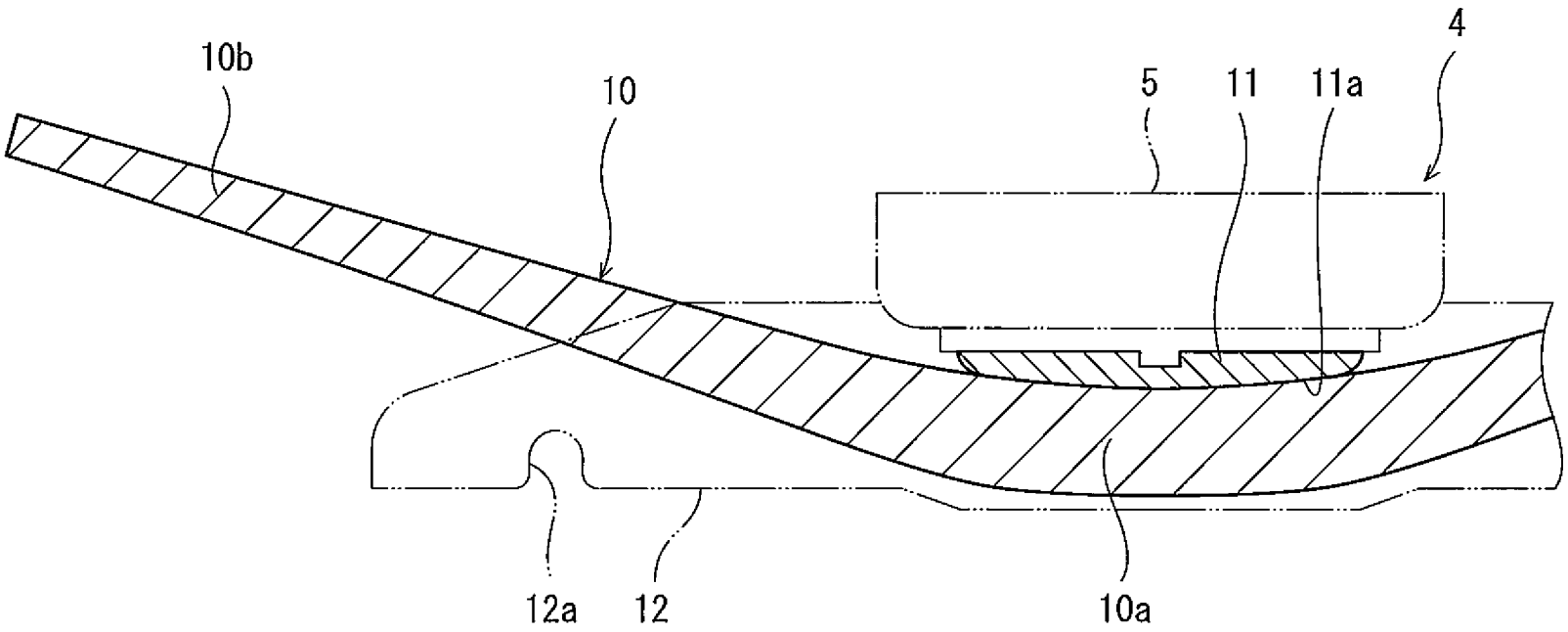
FIG. 2 is a vertical sectional view of major components of the bogie shown in FIG. 1.
Figure 3:
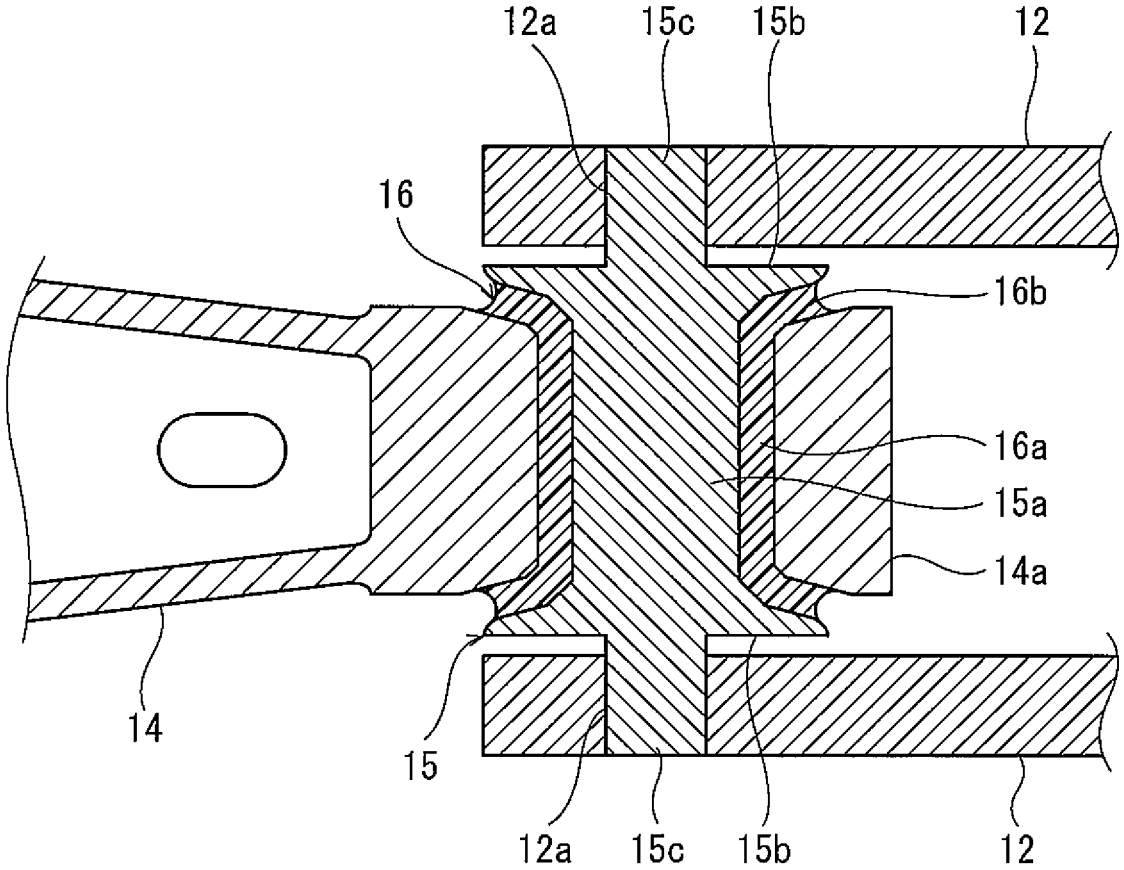
FIG. 3 is a sectional view when viewing a tubular portion of an axle beam of FIG. 1 and its vicinity from below.

FIG. 1 is a side view of a railcar bogie 1 according to the embodiment. FIG. 2 is a vertical sectional view of major components of the bogie 1 shown in FIG. 1. FIG. 3 is a sectional view when viewing a tubular portion 14*a* of an axle beam 14 of FIG. 1 and its vicinity from below. As shown in FIG. 1, the railcar bogie 1 includes a bogie frame 4 supporting a carbody through an air spring 2 as a secondary suspension and a bolster 3. The bogie frame 4 includes a cross beam 5 extending in the car width direction and supporting the carbody (not shown) but does not include so-called side sills.

The cross beam 5 is connected to the bolster 3 so as to be turnable, and the bolster 3 is connected to the carbody through the air spring 2 and a bolster anchor (not shown). A pair of wheelsets 6 are arranged at both respective car longitudinal direction sides of the cross beam 5. Each of the wheelsets 6 includes an axle 6*a* and wheels 6*b*. The axle 6*a* extends in the car width direction. The wheels 6*b* are provided at both respective car width direction sides of the axle 6*a*. Both car width direction side portions of the axle 6*a* are rotatably supported by respective bearings 7, and the bearings 7 are accommodated in respective axle boxes 9 of axle box devices 8.

Each of the axle box devices 8 supports an end portion 10*b* of a plate spring 10 extending in a car longitudinal direction. A longitudinal direction middle portion 10*a* of the plate spring 10 supports a car width direction end portion 5*a* of the cross beam 5. To be specific, the plate spring 10 has both the function of a primary suspension and the function of a conventional side sill. The plate spring 10 is made of, for example, fiber-reinforced resin. In a side view, the plate spring 10 is formed in an arch shape that is convex downward as a whole. The middle portion 10*a* of the plate spring 10 is located lower than the end portions 10*b* and has a circular-arc shape that is convex downward.

As shown in FIGS. 1 and 2, the bogie frame 4 includes a pressing member 11 and a pair of side walls 12. The pressing member 11 is provided at a lower portion of the end portion 5*a* of the cross beam 5. The pair of side walls 12 are arranged at both respective car width direction sides of the pressing member 11 and project from the end portion 5*a* of the cross beam 5 toward a lower side and both sides in the car longitudinal direction. The middle portion 10*a* of the plate spring 10 is located under the pressing member 11. The plate spring 10 passes in the car longitudinal direction through a space sandwiched between the pair of side walls 12. The plate spring 10 is arranged so as to be spaced apart from each of the side walls 12 in the car width direction. In a side view, the middle portion 10*a* of the plate spring 10 is arranged so as to overlap the side walls 12.

The pressing member 11 includes a circular-arc lower surface 11*a*. The pressing member 11 is placed on the middle portion 10*a* of the plate spring 10 from above. The pressing member 11 presses an upper surface of the plate spring 10 by gravitational downward load from the cross beam 5 without being fixed to the plate spring 10 so as to be separable from the upper surface of the plate spring 10. To be specific, the pressing member 11 presses the upper surface of the plate spring 10 without being connected to the plate spring 10 by a fixture (such as a bolt). In other words, the pressing of the pressing member 11 against the upper surface of the plate spring 10 is kept by the gravitational downward load from the cross beam 5 and reaction force of the plate spring 10. With this, the plate spring 10 can swing while changing a region pressed against the lower surface 11*a* of the pressing member 11. It should be noted that the bogie frame 4 may be directly or indirectly placed on the upper surface of the middle portion 10*a* of the plate spring 10. A buffer sheet may be interposed between the pressing member 11 and the plate spring 10.

As shown in FIGS. 1 and 3, each of the axle box devices 8 includes the axle box 9, the axle beam 14, a core rod 15, and an elastic bushing 16. To be specific, the bogie 1 is a so-called axle beam type bogie. Upper surfaces of the axle boxes 9 are inclined toward a longitudinal direction middle side. Spring seats 17 are attached to respective upper portions of the axle boxes 9. The end portion 10*b* of the plate spring 10 extending in the car longitudinal direction is placed on the spring seat 17 from above so as not to be fixed to the spring seat 17, i.e., so as to be separable from the spring seat 17. To be specific, both longitudinal direction end portions 10*b* of the plate spring 10 are supported by the respective axle boxes 9 through the corresponding spring seats 17. Each of the spring seats 17 includes an elastic body 18 (such as a multi-layer rubber) and a receiving member 19. The elastic body 18 is positioned on the upper surface of the axle box 9. The receiving member 19 is positioned on the elastic body 18, and the end portion 10*b* of the plate spring 10 is placed on the receiving member 19. It should be noted that the plate spring 10 and the receiving member 19 are not fixed to each other.

The axle beam 14 extends from the axle box 9 to a bogie middle side in the car longitudinal direction. The tubular portion 14*a* that opens toward both sides in the car width direction is provided at a tip end of the axle beam 14. The tubular portion 14*a* is formed by fixing a semi-tubular portion by bolts to another semi-tubular portion formed integrally with the tip end of the axle beam 14. The core rod 15 is inserted into an internal space of the tubular portion 14*a* in the car width direction. The core rod 15 includes a columnar portion 15*a*, a pair of conical flange portions 15*b*, and projecting end portions 15*c*. The pair of conical flange portions 15*b* are provided at both respective car width direction sides of the columnar portion 15*a*. The projecting end portions 15*c* project outward in the car width direction from both respective side surfaces of the pair of flange portions 15*b*.

The tubular elastic bushing 16 (such as a rubber bushing) is interposed between the core rod 15 and the tubular portion 14*a*. The elastic bushing 16 includes a cylindrical portion 16*a* and a pair of flange portions 16*b*. The pair of flange portions 16*b* project outward in a radial direction from both respective car width direction sides of the cylindrical portion 16*a*. The elastic bushing 16 is externally fitted to the core rod 15. The end portions 15*c* of the core rod 15 project in the car width direction beyond the tubular portion 14*a* of the axle beam 14.

Each of the side walls 12 includes a groove portion 12*a* that opens downward. The groove portion 12*a* is fitted to the end portion 15*c* of the core rod 15 from above. In this state, a lid member 20 is fixed to the side wall 12 from below by bolts (not shown) so as to close a lower opening of the groove portion 12*a*. Thus, the core rod 15 is sandwiched between the side wall 12 and the lid member 20. With this, the core rod 15 is connected to the bogie frame 4.

Next, characteristic matters in a procedure of assembling the bogie 1 will be explained. In assembling the bogie, work (hereinafter simply referred to as "car mounting work") of mounting the bogie frame 4 on the axle box devices 8 provided with the wheelsets 6 and the axle beams 14 is performed. Since the bogie 1 including the plate spring 10 of the present embodiment has a characteristic structure as compared to conventional bogies, the adjustment of the wheelbase by a conventional adjusting method and the car mounting work require a lot of labor. Hereinafter, details will be explained.

In the car mounting work, the end portions 15*c* of the core rod 15 attached to the tip end portion of the axle beam 14 through the elastic bushing 16 are fitted to and fastened to the respective groove portions 12*c* of the side walls 12 of the bogie frame 4. According to a conventional axle beam type bogie including side sills and axle springs, the axle springs are compressed to a height corresponding to a tare, and a core rod is fitted to a groove portion of a bogie frame with the air springs restricted at this height. At this time, by keeping an arm of an axle beam in a substantially horizontal state, the fitting work can be performed while realizing an appropriate wheelbase.

On the other hand, according to the bogie 1 of the present embodiment, it is difficult to compress the plate spring 10 having the function of the axle spring to a height corresponding to the tare and restrict the plate spring 10 at this height, and the bogie frame 4 needs to be mounted with the plate spring 10 at a free height at which any load is not applied. Therefore, in order to fit the core rod 15 to the bogie frame 4, the tip end portion of the axle beam 14 needs to be lifted upward. As a result, the axle beam 14 rotates about the axle 6*a*, and this changes the position of the spring seat 17.

In the bogie 1 of the present embodiment, position adjustment of the plate springs 10 and the bogie frame 4 are performed in such a manner that: in a side view, a center of each plate spring 10 and a center position of the bogie frame 4 are made to coincide with each other; and car longitudinal direction sizes of gaps (four gaps in one bogie) each formed between the longitudinal direction end portion of the plate spring 10 and the spring seat 17 in the car longitudinal direction are made to be equal to one another. However, as described above, when the core rod 15 of the axle box device 8 is fitted and fastened to the bogie frame 4, the axle beam 14 rotates, and this changes the gap between the longitudinal direction end portion of the plate spring 10 and the spring seat 17. Therefore, the position adjustment of the plate springs 10 and the bogie frame 4 requires size managing work of equalizing the four gaps. Thus, the car mounting work requires a lot of labor and time.

According to the present embodiment, the car mounting work can be significantly reduced by using a wheelbase fixing jig 40.

Figure 4A:
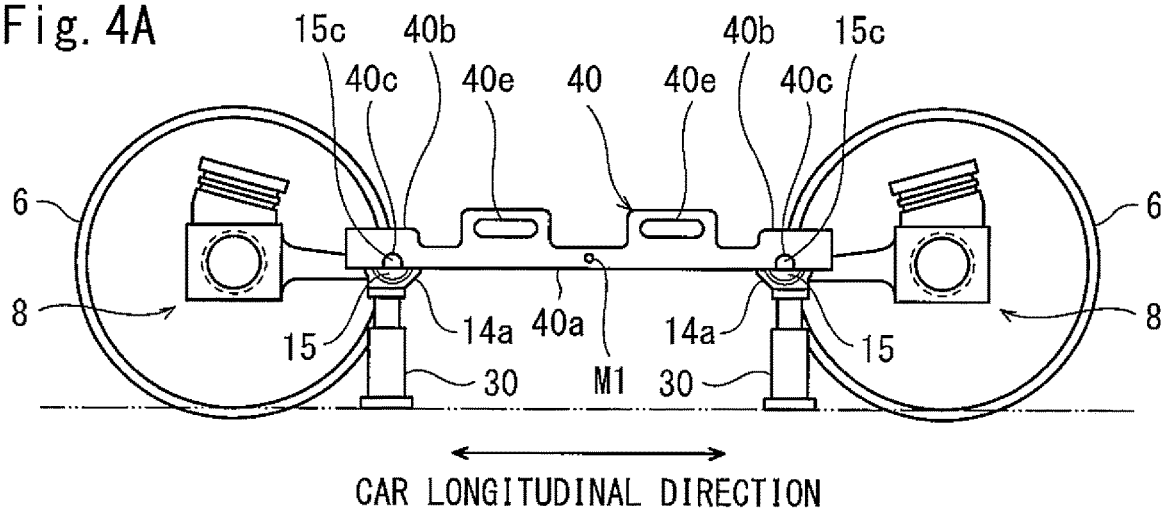
FIGS. 4A to 4C are diagrams for explaining a procedure of assembling the bogie.
Figure 4B:
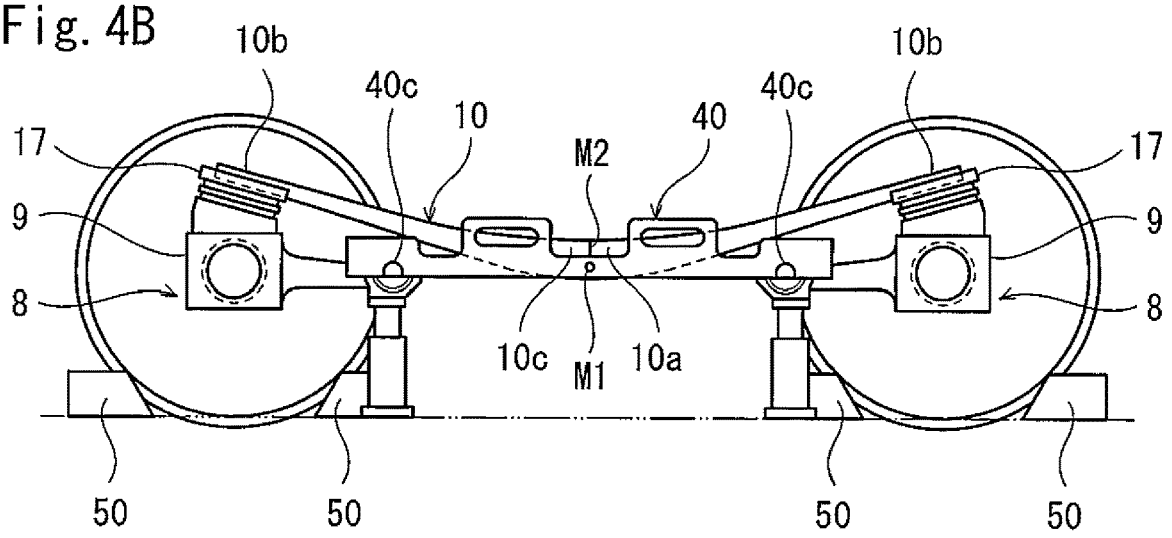
Figure 4C:
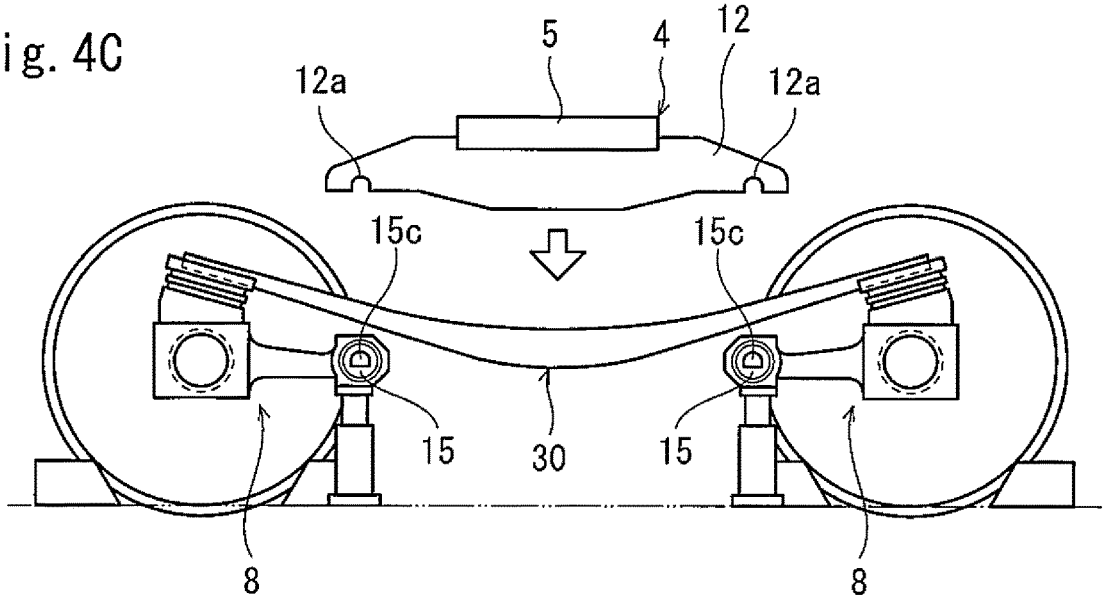

FIGS. 4A to 4C are diagrams for explaining a procedure of assembling the bogie. As shown in FIG. 4A, before the plate spring 10 and the bogie frame 4 are provided, a pair of axle box devices 8 supporting the wheelsets 6 are arranged away from each other in the car longitudinal direction by a worker, and support jigs 30 provided on a ground surface support the respective tubular portions 14*a* of the axle box devices 8 from below. With the tubular portion 14*a* supported by the support jig 30, the axle beam 14 extends horizontally from the axle box 9 to the bogie middle side. In this state, the pair of axle box devices 8 are positioned by using the wheelbase fixing jig 40.

The wheelbase fixing jig 40 is a plate-shaped body which extends in the car longitudinal direction and is used with plate surfaces thereof facing in the car width direction. A marking M1 (for example, a hole) is provided at a longitudinal direction middle portion 40*a* of the wheelbase fixing jig 40. A pair of longitudinal direction end portions 40*b* of the wheelbase fixing jig 40 include respective concave locking portions 40*c* which are cut out so as to open downward. When viewed from the car width direction, each of the locking portions 40*c* has such a shape as to fit the end portion 15*c* of the core rod 15. Each of annular holding portions 40*e* that the worker can hold with hands is formed at a portion between the middle portion 40*a* and the end portion 40*b* in the wheelbase fixing jig 40.

The worker fits the locking portions 40*c* of the wheelbase fixing jig 40 to the respective end portions 15*c* of the core rods 15 from above. With this, the wheelbase fixing jig 40 is locked to the pair of axle box devices 8. Thus, the pair of axle box devices 8 are positioned, and the wheelbase (i.e., a distance between the pair of wheelsets 6 in the car longitudinal direction) coincides with a predetermined designed value (positioning step).

Next, as shown in FIG. 4B, in addition to the wheelbase fixing jig 40, wedge-shaped wheel stoppers 50 are brought into press-contact with the wheels 6*b* to fix the wheelbase. Then, the plate spring 10 extending in the car longitudinal direction is supported by the pair of axle box devices 8 (plate spring arranging step). Specifically, the end portions 10*b* of the plate spring 10 are placed from above on the respective spring seats 17 provided at upper portions of the axle boxes 9 of the axle box devices 8. In this state, the middle portion 40*a* of the wheelbase fixing jig 40 is arranged along a car width direction outer side surface 10*c* of the middle portion 10*a* of the plate spring 10. To be specific, in the present embodiment, the middle portion 40*a* of the wheelbase fixing jig 40 is a spring adjacent portion.

When viewed from the car width direction, at least a part of the side surface 10*c* of the middle portion 10*a* of the plate spring 10 protrudes from the wheelbase fixing jig 40 in a vertical direction. As a marking corresponding to the marking M1 of the wheelbase fixing jig 40, a marking M2 (for example, a marking line extending in the vertical direction) is provided at a longitudinal direction center of the side surface 10*c* of the plate spring 10. When viewed from the car width direction, the marking M2 of the plate spring 10 protrudes from the wheelbase fixing jig 40 in the vertical direction.

The marking M1 of the wheelbase fixing jig 40 is located at a center between the pair of locking portions 40*c*. To be specific, when the marking M1 of the wheelbase fixing jig 40 and the marking M2 of the plate spring 10 coincide with each other in the car longitudinal direction, this means that the plate spring 10 is provided at an appropriate position relative to the pair of axle box devices 8. Therefore, the worker visually confirms whether or not there is a positional displacement between the marking M1 of the wheelbase fixing jig 40 and the marking M2 of the plate spring 10 in the car longitudinal direction (positional displacement confirming step). When there is the positional displacement, the position of the plate spring 10 in the car longitudinal direction is adjusted. When there is no positional displacement, the process proceeds to the next step.

Next, as shown in FIG. 4C, the wheelbase fixing jig 40 is detached from the core rods 15, and the middle portion 10*a* of the plate spring 10 is made to support the bogie frame 4. Specifically, the bogie frame 4 is placed on the middle portion 10*a* of the plate spring 10 from above so as to be separable from the middle portion 10*a*, and the groove portions 12*a* of the side walls 12 of the bogie frame 4 are fitted to the respective end portions 15*c* of the core rods 15 from above. At this time, since the wheelbase is appropriately set in advance by the wheelbase fixing jig 40, it is unnecessary to finely adjust the positions of the wheelsets 6 in accordance with the bogie frame 4, and the positional displacement between the bogie frame 4 and the plate spring 10 in the car longitudinal direction is prevented. In this state, the lid members 20 (see FIG. 1) are fixed to the side walls 12 by bolts so as to close the lower openings of the groove portions 12*a*. Thus, the bogie frame 4 is coupled to the pair of axle box devices 8 (bogie frame arranging step).

As explained above, before the plate spring 10 and the bogie frame 4 are assembled in assembling the bogie 1, the wheelbase fixing jig 40 extending in the car longitudinal direction is just locked to the pair of axle box devices 8. With this, the wheelbase of the bogie 1 is kept at a designed value. Therefore, the work of keeping the wheelbase at a designed value when the pair of axle box devices 8 provided away from each other in the car longitudinal direction are made to support the plate spring 10 extending in the car longitudinal direction can be facilitated.

Since the wheelbase fixing jig 40 is locked to the core rods 15, it is unnecessary to provide, at the axle box devices 8, special members to which the wheelbase fixing jig 40 is locked. Thus, the structure of the bogie 1 can be simplified. Since the markings M1 and M2 are provided at the wheelbase fixing jig 40 and the plate spring 10, the positional displacement of the plate spring 10 relative to the pair of axle box devices 8 can be easily confirmed.

The present invention is not limited to the above embodiment, and modifications, additions, and eliminations may be made with respect to the configuration of the present invention. For example, the marking M1 does not have to be located at the car longitudinal direction center of the wheelbase fixing jig 40, and the marking M2 does not have to be located at the car longitudinal direction center of the plate spring 10. The markings M1 and M2 are only required to be set such that when the markings M1 and M2 coincide with each other in the car longitudinal direction, the plate spring 10 is arranged at an appropriate position. Each of the markings M1 and M2 is not limited to a marking line or a hole and may be the other form (for example, a punch mark or a notch). The bogie 1 is an axle beam type bogie but may be a different type of bogie. The bogie 1 is a bogie with a bolster but may be a bolsterless bogie.

REFERENCE SIGNS LIST

1 bogie
4 bogie frame
6 wheelset
8 axle box device
9 axle box
10 plate spring
14 axle beam
14*a* tubular portion
15 core rod
16 elastic bushing
40 wheelbase fixing jig
40*a* middle portion (spring adjacent portion)
40*c* locking portion
M1, M2 marking

The invention claimed is:

1. A method of assembling a railcar bogie,
the method comprising:
a positioning step of locking a wheelbase fixing jig to a pair of axle box devices to position the pair of axle box devices, the pair of axle box devices being arranged away from each other in a car longitudinal direction, the wheelbase fixing jig extending in the car longitudinal direction;
a plate spring arranging step of making the pair of axle box devices support a plate spring extending in the car longitudinal direction; and
a bogie frame arranging step of (i) detaching the wheelbase fixing jig from the pair of axle box devices, (ii) making a longitudinal direction middle portion of the plate spring support a bogie frame and (iii) coupling the bogie frame to the pair of axle box devices.

2. The method according to claim 1, wherein:
each of the axle box devices includes
an axle box accommodating a bearing supporting the corresponding wheelset,
an axle beam extending from the axle box in the car longitudinal direction and including a tip end at which a tubular portion is provided, the tubular portion being open toward both sides in a car width direction,
a core rod inserted into an internal space of the tubular portion in the car width direction, and
an elastic bushing interposed between the tubular portion and the core rod;
in the positioning step, the wheelbase fixing jig is locked to end portions of the core rods of the pair of axle box devices; and
in the bogie frame arranging step, the bogie frame is coupled to the core rods of the pair of axle box devices.

3. The method according to claim 2, further comprising, after the plate spring arranging step and before the bogie frame arranging step, a positional displacement confirming step of confirming whether or not there is a positional displacement between the wheelbase fixing jig and the plate spring in the car longitudinal direction.

4. The method according to claim 1, further comprising, after the plate spring arranging step and before the bogie frame arranging step, a positional displacement confirming step of confirming whether or not there is a positional displacement between the wheelbase fixing jig and the plate spring in the car longitudinal direction.

5. The method according to claim 1, wherein
the bogie frame includes:
a cross beam, and
a pair of side walls that are arranged at both respective car width direction sides of the cross beam and respectively project from end portions of the cross beam toward a lower side and both sides in the car longitudinal direction; and
in the bogie frame arranging step, the pair of side walls are coupled to the pair of axle box devices.

6. The method according to claim 1, wherein in the positioning step, the axle box devices are supported from below by support jigs provided on a support surface.

7. The method according to claim 1, wherein wheels are attached to the pair of axle box devices, and are in contact with a support surface, the method further comprising:
placing wheel stoppers on the support surface and in press-contact with the wheels, prior to detaching the wheelbase fixing jig from the pair of axle box devices.

8. The method according to claim 1, wherein:
each axle box device includes a core rod;
the wheelbase fixing jig includes locking portions that respectively lock to the core rod of each axle box, the locking portions being spaced apart in the car longitudinal direction by a distance;
the bogie frame includes side walls that have groove portions that are spaced apart by the same distance as the locking portions of the wheelbase fixing jig; and
the groove portions of the side walls are attached to the core rods of the axle box devices, after detaching the wheelbase fixing jig from the pair of axle box devices.

9. A wheelbase fixing jig for use in assembling of a railcar bogie,
the wheelbase fixing jig being configured to position a pair of axle box devices in order that the pair of axle box devices support a plate spring extending in a car longitudinal direction, the pair of axle box devices being arranged away from each other in the car longitudinal direction, the wheelbase fixing jig being configured to be detached from the pair of axle box devices during a manufacturing process of the railcar bogie,
the wheelbase fixing jig extending in the car longitudinal direction and comprising a pair of locking portions located at both respective longitudinal direction end portions of the wheelbase fixing jig, the pair of locking portions being locked to the respective axle box devices, wherein:
the locking portions of the wheelbase fixing jig are configured to lock to core rods respectively included in the axle box devices, the locking portions being spaced apart in the car longitudinal direction by a distance; and
the distance between the locking portions is the same as a distance between groove portions in side walls of a bogie frame that are configured to respectively attach to the core rods after detachment of the wheelbase fixing jig from the core rods.

10. The wheelbase fixing jig according to claim 9, further comprising a spring adjacent portion arranged between the pair of locking portions along a car width direction outer side surface of the plate spring, wherein a marking corresponding to a marking provided at the side surface of the plate spring is provided at a car width direction outer side surface of the spring adjacent portion.

11. The wheelbase fixing jig according to claim 9, further comprising a middle portion that is arranged along a car width direction outer side surface of a middle portion of the plate spring.

* * * * *